US011825578B2

(12) United States Patent
Saes et al.

(10) Patent No.: US 11,825,578 B2
(45) Date of Patent: Nov. 21, 2023

(54) SMART STARTING UP METHOD BY AN LED DRIVER

(71) Applicant: eldoLAB Holding B.V., Son en Breugel (NL)

(72) Inventors: Marc Saes, Son en Breugel (NL); Nicolaas Johannes Antonius Gommans, Son en Breugel (NL); Tijs Versteegde, Eindhoven (NL)

(73) Assignee: eldoLAB Holding B.V., Son en Breugel (NL)

( * ) Notice: Subject to any disclaimer, the term of this patent is extended or adjusted under 35 U.S.C. 154(b) by 6 days.

(21) Appl. No.: 17/628,067

(22) PCT Filed: Jul. 16, 2020

(86) PCT No.: PCT/EP2020/070175
§ 371 (c)(1),
(2) Date: Jan. 18, 2022

(87) PCT Pub. No.: WO2021/013699
PCT Pub. Date: Jan. 28, 2021

(65) Prior Publication Data

US 2022/0322510 A1 Oct. 6, 2022

(30) Foreign Application Priority Data

Jul. 24, 2019 (NL) ..... 2023562

(51) Int. Cl.
*H05B 45/385* (2020.01)
*H05B 45/34* (2020.01)
*H05B 45/54* (2020.01)

(52) U.S. Cl.
CPC ..... *H05B 45/385* (2020.01); *H05B 45/34* (2020.01); *H05B 45/54* (2020.01)

(58) Field of Classification Search
CPC ..... H05B 45/385; H05B 45/34; H05B 45/54; H05B 45/37
See application file for complete search history.

(56) References Cited

U.S. PATENT DOCUMENTS

2004/0217712 A1* 11/2004 Takeda ..... H05B 45/14 362/276
2012/0319604 A1* 12/2012 Walters ..... H05B 45/327 363/126

FOREIGN PATENT DOCUMENTS

EP 2239997 A1 10/2010
EP 2600694 A1 * 6/2013 ..... H05B 33/089
(Continued)

OTHER PUBLICATIONS

International Search Report and Written Opinion for International Application No. PCT/EP2020/070175, dated Aug. 25, 2020, 10 pages.

(Continued)

*Primary Examiner* — Daniel D Chang
(74) *Attorney, Agent, or Firm* — RatnerPrestia

(57) ABSTRACT

A method for starting up an illuminating process of a plurality of series connected LEDs by means of a LED driver is described, whereby a maximum allowed voltage output of the LED driver is lower than a forward voltage of the plurality of series connected LEDs in a cold state.
The method comprises:

d) providing a first current, in value lower than a desired current, by the LED driver to the plurality of series connected LEDs, resulting in a forward voltage across the plurality of series connected LEDs lower than the maximum allowed voltage output of the LED driver, e) waiting during a predetermined wait time period, (Continued)

f) stepping up of the first current to a second current provided by the LED driver to the plurality of series connected LEDs.

24 Claims, 6 Drawing Sheets

(56) References Cited

FOREIGN PATENT DOCUMENTS

| | | | |
|---|---|---|---|
| EP | 2600694 | A1 | 6/2013 |
| JP | 2012015052 | A | 1/2012 |

OTHER PUBLICATIONS

Netherlands Search Report and Written Opinion for NL Application No. 2023562, dated Dec. 19, 2019, 12 pages.

* cited by examiner

SMART STARTING UP METHOD BY AN LED DRIVER

RELATED APPLICATIONS

This application is a U.S. National Phase Patent Application of International Application Number PCT/EP2020/070175, filed 16 Jul. 2020, which claims priority to Netherlands Application No. NL 2023562, filed 24 Jul. 2019, the disclosures of which are incorporated herein by reference in their entirety for all purposes.

BACKGROUND OF THE INVENTION

The technical field of the present invention relates to illumination systems using Light Emitting Diodes (LEDs).

At present, conventional lighting applications are more and more replaced by illumination systems using LEDs. LEDs have several advantages over incandescent lighting, such as higher power to light conversion efficiency, faster and more precise lighting intensity and colour control.

In general, an LED based illuminating application comprises a plurality of LEDs, frequently connected in series, and an LED driver for powering the LEDs by providing a current through the LEDs. Such an LED driver in general comprises a power converter such as a switched mode power supply (e.g. a Buck or Boost converter) and a control unit for controlling the power converter. When a current is supplied to the plurality of series connected LEDs, a forward voltage across the plurality of series connected LEDs is generated.

Given the forward voltage across the plurality of series connected LEDs, only a limited number of LEDs can be driven by an LED driver; the output voltage that can be generated by the power converter of the LED driver may be limited and/or the output voltage of the power converter may be limited due to a safety limit (e.g. 60 V), e.g. imposed by a safety standard.

SUMMARY OF THE INVENTION

The invention intends to provide a method to drive a plurality of series connected LEDs in such manner that the number of series connected LEDs that can be powered is increased, given a limitation of the output voltage of an LED driver, e.g. due to hardware limitations or a safety limit. Regarding the latter, it can be pointed out that there are different types of safety standards, like for example the Safety Extra Low Voltage (SELV). The SELV standard defines the electrical specs and/or ranges, by which the system is limited to operate.

In order to achieve this or other goals, the invention provides a first method for starting up an illuminating process of a plurality of series connected LEDs by means of an LED driver, whereby a maximum allowed voltage output of the LED driver is lower than a forward voltage of the plurality of series connected LEDs in a cold state, at a desired current, which comprises:

a) providing a first current, in value lower than the desired current, by the LED driver to the plurality of series connected LEDs, resulting in a forward voltage across the plurality of series connected LEDs lower than the maximum allowed voltage output of the LED driver,
b) waiting during a predetermined wait time period,
c) stepping up the first current to a second current provided by the LED driver to the plurality of series connected LEDs.

According to the invention, a first method for starting up an illuminating process of a plurality of series connected LEDs is described. According to the first method, the plurality of series connected LEDs are switched on, i.e. the process of starting up, from a cold state by the LED driver. An illuminating process refers to using or applying a light source, such process can e.g. be initiated or started by e.g. pushing a button of a switch of a user interface. To switch on an LED, a current is needed, which is delivered by the LED driver. Typically, the LED driver has a maximum allowed voltage output. Within the meaning of the present invention, the maximum allowed voltage that can be outputted by the LED driver may either refer to a hardware limited maximum voltage, i.e. the maximum voltage the LED driver can generate, or it can refer to a maximum voltage that is imposed as a limiting operating condition, e.g. to meet certain safety standards or regulations. The cold state of the plurality of series connected LEDs is a state wherein, for example, no current is provided by the LED driver to the plurality of series connected LEDs during a certain period, for example 1-5 minutes or more. The plurality of series connected LEDs represents a string with more than one LED unit placed in serial connection. When the LED driver provides a current to the plurality of series connected LEDs, the operating temperature of the LEDs will increase. Due to the increased operating temperature the forward voltage across the plurality of series connected LEDs will decrease. The forward voltage decrease depends e.g. on the type of LED and operating temperature. In general use, an LED commonly exhibits a direct relation between the forward voltage decrease and operating temperature, which is commonly situated between −1 mV/° C. to −5 mV/° C.

In a first step of the first method according to the invention, the providing of the first current, in value lower than the desired current, by the LED driver is established. Such first current may e.g. be a fraction of the desired current, preferably 10%-60% of the desired current, more preferably 30%-50% of the desired current.

The desired current may e.g. be the nominal current. Typically, the nominal current is the current which can continuously flow through an LED and which causes the LED to operate at a desired operating temperature or within a certain temperature range, so as to ensure a certain desired lifetime of the LED, e.g. expressed in illumination hours.

The method according to the invention aims to start up an illumination process for a plurality of series connected LEDs whereby a forward voltage of said plurality of series connected LEDs, at the desired current, in a cold state, would be higher than the available or allowable output voltage of the LED driver. The solution proposed to achieve this starts with providing a first current, lower than the desired current, to the plurality of series connected LEDs. It is implied that the forward voltage of the plurality of series connected LEDs at this first current, even when the LEDs are in the cold state, is smaller than or equal to the maximum allowed voltage output of the LED driver. As such, the LED driver will be capable of supplying the first current to the plurality of series connected LEDs. As a result of the application of the first current to the LEDs, the temperature of the LEDs will increase and the forward voltage of the LEDs will decrease.

After providing the first current by the LED driver to the plurality of series connected LEDs, a predetermined wait time period is applied in a second step of the first method according to the invention. During said predetermined wait time period, the current as supplied by the LED driver is maintained at the first current. The predetermined wait time period is selected to sufficiently heat the plurality of series connected LEDs so as to increase the operating temperature. Preferably, the predetermined wait time period of the first method according to the invention is between 0-10 microseconds, preferable between 5-10 microseconds.

During the waiting time period, the forward voltage across the plurality of series connected LEDs will decrease, due to the increased operating temperature, which allows to step up the first current to a second current by the LED driver, in the third step of the first method according to the invention. In an embodiment, the provided second current may be the desired current.

The first method according to the invention enables to start up or switch a larger number of LEDs by an LED driver, compared to known LED driver and light source combinations.

This may be easily demonstrated by a numerical example. Suppose that each LED unit of the plurality of series connected LEDs has a temperature dependence of the forward voltage of −2 mV/° C. The operating temperature in the cold state is e.g. considered to be room temperature, i.e. 25° C. The desired current is taken as the nominal current of the LEDs which is 700 mA and the forward voltage of one LED unit in the cold state is 2.3 V. The maximum allowed voltage output which the LED driver may deliver is assumed to be 60 V. In this situation, the LED driver could drive 26 LEDs in serial connection. When applying a first current of 50% of the desired current, i.e. 350 mA, the operating temperature will approximately linearly increase with 10° C./microsec (until a maximum operating temperature of 125° C. is reached). The wait time period until the LED driver steps up the first current to the second current is set at 10 microsec. In this example, the second current is equal to the nominal current. After the wait time period, the operating temperature of the LEDs is thus increased by 100° C., which causes a forward voltage decrease of 200 mV across each LED.

As such, the forward voltage of one LED unit in this state is 2.1 V. This allows for 2 extra LEDs to be put in the serial connection. When operating in this state, i.e. achieved by applying the first method according to the invention, the LED driver is able to drive 28 LEDs instead of 26 LEDs.

Hence, an advantage of the first method according to the invention, is that the number of series connected LEDs to be driven can be increased with a given maximum allowed voltage output of the LED driver.

The advantage of the first method according to the invention, may also be described as enabling an optimization or maximization of the number of LEDs or LED units that can be powered, given a maximum voltage that can be outputted by the LED driver. In case the maximum voltage that can be outputted or generated by an LED driver is lower than the combined forward voltage of a number of LEDs, e.g. an LED string, in a cold state at a desired current, one can, using the first method according to the invention, start powering the LED string using a reduced current, i.e. a current that is lower than the desired current, the reduced current being selected such that the required forward voltage at the reduced current is lower than the maximum voltage that can be outputted or generated. Due to the application of the reduced current, the temperature of the LED string will increase, resulting in a lowering of the required forward voltage. Once the required forward voltage has lowered, the applied current can be increased, e.g. stepwise, towards the desired current.

In an advantageous embodiment, the LED driver is arranged to step up the first current to a second current, wherein the second current is the nominal current of the plurality of series connected LEDs. The nominal current can be determined by the specifications of the plurality of series connected LEDs. For example, a user can provide the nominal current characteristic to the LED driver. As an alternative, the nominal current characteristic can be provided to the LED driver by arranging the LED driver to determine the nominal current directly from the plurality of series connected LEDs.

According to a second aspect of the invention, there is provided a second method for starting up an illuminating process of a plurality of series connected LEDs by means of a LED driver, whereby a maximum allowed voltage output of the LED driver is lower than a forward voltage of the plurality of series connected LEDs in a cold state at a desired current, the method comprises:

a) providing a first current, in value lower than the desired current, by the LED driver to the plurality of series connected LEDs, resulting in a forward voltage across the plurality of series connected LEDs not exceeding the maximum allowed voltage output of the LED driver, b) stepping up the first current to a second current provided by the LED driver to the plurality of series connected LEDs, when the forward voltage across the plurality of series connected LEDs is lower than a predetermined fraction of the maximum allowed voltage output or maximum allowed output voltage minus a predetermined voltage step of the LED driver, c) repeating step b) until the desired current or the predetermined fraction of the maximum allowed voltage is reached.

With the second method according to the invention, the same or similar advantages can be achieved as with the first method according to the invention. In a first step of the second method according to the invention, the providing of the first current, in value lower than the desired current, by the LED driver is established. Such first current may e.g. be fraction of the desired current, preferably 10%-60% of the desired current, more preferably 30%-50% of the desired current. However, the range for the first current depends on many factors, e.g. the number of LEDs in the string, ratio of forward voltage change over temperature change of the LEDs and speed of heating up of the LEDs. It is implied that the forward voltage of the plurality of series connected LEDs at this first current, even when the LEDs are in the cold state, is smaller than or equal to the maximum allowed voltage output of the LED driver. As such, the LED driver will be capable of supplying the first current to the plurality of series connected LEDs. As a result of the application of the first current to the LEDs, the temperature of the LEDs will increase and the forward voltage of the LEDs will decrease.

Once having provided the first current by the LED driver to the plurality of series connected LEDs, the forward voltage across the plurality of series connected LEDs decreases, due to the warming up of the LEDs. When the forward voltage is lower than a predetermined fraction of the maximum allowed voltage output or maximum allowed output voltage minus a predetermined voltage step of the LED driver, the LED driver steps up the first current to a second current in the second step of the second method.

The second step of the second method is repeated in the third step until the desired current or the predetermined fraction of the maximum allowed voltage output or maximum allowed output voltage minus a predetermined voltage step of the LED driver is reached. As a result, a steady-state of the current is reached. Note that during the first or second method according to the invention, when the plurality of series connected LEDs comprises LEDs of different colors, it is typically desirable to ensure that the color as generated by the LEDs substantially remains the same, e.g. equal to a user defined color set point. Phrased differently, it is desirable to keep the colorpoint at the same position in the chromaticity diagram during the first or second method.

In this respect, it can be pointed out that, in case of a multi-channel LED driver, each channel of the LED driver e.g. configured to drive an LED group of a particular color, that the current increments as applied to the different channels should be such that the increase of current in each channel causes the color of the combined plurality of LEDs to substantially remain the same, i.e. to keep the colorpoint at the same position in the chromaticity diagram.

In an embodiment, the forward voltage across the plurality of series connected LEDs in step a) of the second method according to the invention is maximally equal to the maximum allowed voltage output of the LED driver. In order to establish the required forward voltage, for example a feedback loop can be applied to maintain the forward voltage across the plurality of the series connected LEDs at a predetermined fraction of the maximum allowed voltage output or maximum allowed output voltage minus a predetermined voltage step of the LED driver. Preferably, the predetermined fraction in step b) of the second method according to the invention is between 90%-95% of the maximum allowed voltage output of the LED driver. For an LED driver with an maximum allowed voltage output of 60 V, the predetermined fraction of the maximum allowed voltage output or maximum allowed output voltage minus a predetermined voltage step of the LED driver may typically be at 55 to 57 V in order to allow for tolerances, ripple and control deviations. In an embodiment, the second method according to the invention could be ended when the predetermined fraction of the maximum allowable voltage of the LED driver is not reached after a predetermined period.

In an embodiment, the step b) of the second method according to the invention is preceded by measuring the forward voltage across the plurality of series connected LEDs by a voltage measurement circuit. Based on the voltage measurement, the LED driver can step up the first current to a second current. Another example is that step b) of the second method according to the invention is preceded by measuring the current through the plurality of series connected LEDs by a current measurement circuit. The current measurement could be performed by a resistance element, arranged in series with the plurality of series connected LEDs. Based on the current measurement, the LED driver can step up the first current to a second current.

The second method according to the invention enables to start up or power a larger number of LEDs by an LED driver, compared to known LED driver and light source combinations. This may be easily demonstrated by a numerical example. Suppose that each LED unit of the plurality of series connected LEDs has a temperature dependence of the forward voltage of −4 mV/° C. The operating temperature in the cold state is e.g. considered to be room temperature, i.e. 20° C. The desired current of the LEDs is 1000 mA and the forward voltage of one LED unit in the cold state is e.g. 3.1 V at the desired current. The maximum allowed voltage output which the LED driver can deliver is assumed to be 60 V. In this situation, the LED driver could drive 19 LEDs in serial connection. In accordance with the second method according to the invention, at least 20 LEDs can be operated. In accordance with the second method, a first current, in value lower than a desired current, is supplied by the LED driver to the plurality of series connected LEDs, the first current resulting in a forward voltage across the plurality of series connected LEDs not exceeding the maximum allowed voltage output of the LED driver. Said first current can e.g. be 50% of the desired current, i.e. 500 mA. As a result of the application of the first current, the operating temperature of the LEDs will increase, e.g. at a rate of 15 degrees/microsec, and the forward voltage across the LEDs will decrease. In accordance with the second method according to the invention, the first current is increased when the forward voltage across the LEDs is lower than a predetermined fraction of the maximum allowed voltage output or maximum allowed output voltage minus a predetermined voltage step of the LED driver. The predetermined fraction of the maximum allowed voltage output or maximum allowed output voltage minus a predetermined voltage step of the LED driver may be set at e.g. 99.5%, i.e. 59.7 V. At the moment the first current is provided by the LED driver, the forward voltage across the LEDs may be determined by a voltage measurement circuit, which forward voltage may be e.g. 55 V. In accordance with the second method according to the invention, the first current is increased by the LED driver to a second current, which second current may be e.g. 75% of the desired current, i.e. 750 mA. In this example, the second current sets the forward voltage at e.g. 58 V. Again, the forward voltage across the plurality of series connected LEDs is lower than the predetermined fraction of the maximum allowed voltage output or maximum allowed output voltage minus a predetermined voltage step of the LED driver. Finally, the second current is stepped up by the LED driver to a third current, which third current is e.g. the desired current. The third current results in a forward voltage of e.g. 59.9 V.

When operating in this state, i.e. achieved by applying the second method according to the invention, the LED driver is able to drive 20 LEDs instead of 19 LEDs. Note that the regulated step-wise manner can be fine-tuned in more or smaller steps to obtain a continuous regulation of the provided current to the plurality of series connected LEDs. Hence, an advantage of the second method according to the invention, is that the number of series connected LEDs to be driven can be increased with a given maximum allowed voltage output of the LED driver.

In an embodiment, a third method according to the invention is provided, wherein a first current is provided to the plurality of series connected LEDs, resulting in a forward voltage across the plurality of series connected LEDs higher than a maximum allowed voltage output of the LED driver (e.g. 60 V) for a time period that is shorter than a predetermined wait time period. In this respect, it can be pointed out that certain safety regulations impose a maximum allowable voltage (e.g. 60 V), but only when said maximum allowable voltage is exceeded during a predetermined period. Phrased differently, an LED driver may generate a voltage exceeding the maximum allowable voltage of the safety regulations, provided that the voltage only exceeds the maximum allowable voltage for a duration shorter than the predetermined period. By doing so, a faster heating of the LEDs or LED groups can be established, resulting in a faster decrease of the required forward voltage.

According to a further aspect of the invention, there is provided a first LED driver configured to drive a plurality of series connected LEDs, whereby a maximum allowed voltage output of the LED driver at an output terminal is lower than a forward voltage of the plurality of series connected LEDs in a cold state, the LED driver comprising:

a power converter for converting an input power at an input terminal to a current at the output terminal, a control unit arranged to control the power converter, as such the power converter provides the current to the plurality of series connected LEDs, and wherein the control unit of the first LED driver is further arranged to:

send a first control signal to the power converter to control the power converter to provide a first current, in value lower than a desired current, to the plurality of series connected LEDs, resulting in a forward voltage across the plurality of series connected LEDs lower than the maximum allowed voltage output of the first LED driver, send a second control signal to the power converter after a predetermined wait time period to control the power converter to step up the first current to a second current.

In general, the power converter of first LED driver according to the invention is powered at an input terminal by a power supply, e.g. a DC power supply derived from a mains supply by means of an AC/DC converter. Such an AC (alternating current)/DC (direct current) converter can be arranged to convert an alternating current source (or more general, a power source) to a substantially direct current source (or more general, a power source). AC/DC converters are widely applied to convert an AC power source such as a mains connection (e.g. 230 V, 50 Hz) to a DC power source. The output of said DC power source may then be applied to power a load or may be applied to power a further power source such as a power converter of an LED driver.

In an embodiment according to the invention, the input terminal of the power converter of the first LED driver is connected to a supply voltage.

The plurality of series connected LEDs are powered by a power converter, which power converter can be a switched mode power supply (SMPS). Such a switched mode power source may e.g. comprise an inductance, a unidirectional element such as a diode and a switching element, e.g. a FET or a MOSFET. The switching of the switching element can e.g. be controlled by a controller or control unit. At present, different types of power sources (in particular current sources) are applied for such powering of the plurality of series connected LEDs. As an example, a so-called buck-regulator can be applied. It is further acknowledged that other types of power converters such as boost, buck-boost, CUK, SEPIC or other, either synchronous or non-synchronous may advantageously be applied in combination with the present invention.

To control the power converter to provide a first current, in value lower than a desired current, to the plurality of series connected LEDs, a control unit of the first LED driver may send a first control signal to the power converter. The first current results in a forward voltage across the plurality of series connected LEDs lower than the maximum allowed voltage output of the first LED driver. The first control signal could be an on/off signal, e.g. an analogue or digital signal, to switch on/off the switching element of the power converter.

To control the power converter to step up the first current to a second current, the control unit sends a second control signal to the power converter after a predetermined wait time period. Preferably, the predetermined wait time period is between 0-10 microseconds, more preferably between 5-10 microseconds. The second control signal could be an on/off signal, e.g. an analogue or discrete signal, to switch on/off the switching element of the power converter.

The control unit may comprise any type of control unit, including e.g. analogue control electronics, digital control electronics, such as a micro controller, microprocessor, or any other suitable control device such as a Field Programmable Gate Array (FPGA), a programmable logic device (PLD), discrete logic electronics etc.

With respect to the manners to control a power converter such as an SMPS, it can be pointed out that such a power converter can be controlled in a voltage control mode or in a current control mode.

In a voltage control mode, the output voltage as generated by the LED driver, may be controlled to comply with a desired value. In such embodiment, one can e.g. compare an input signal of the LED driver which represents a desired output voltage of the LED driver, with a voltage signal representing an output voltage of the LED driver. By controlling an LED driver in such manner, one can e.g. ensure that an output voltage of the LED driver does not exceed a predetermined boundary, e.g. a voltage imposed by a safety regulation.

In a current control mode, the output current as provided by the LED driver to an LED based light source, may be controlled to comply with a desired value. In such embodiment, one can e.g. compare an input signal of the LED driver which represents a desired output current of the LED driver, with a current signal representing an output current of the LED driver.

In an embodiment of the present invention, an LED driver may be configured to perform the first method according to the invention while being controlled according to a current control mode.

In such embodiment, the LED driver, in particular a control unit of the LED driver, may be configured to determine a first current to be applied to the plurality of series connected LEDs, said first current being lower that a desired current, whereby said first current results in a forward voltage lower than a predetermined boundary, e.g. imposed by a safety limit. In such embodiment, the control unit of the LED driver may require information about the voltage vs. current characteristic of the LEDs as applied, in particular about the temperature dependency of said characteristic, in order to determine the first current. Based on said information, the control unit may determine a sufficiently low first current, resulting in a forward voltage that does not breach the safety limit.

Alternatively or in addition, the LED driver may be equipped with a voltage controller or limiter that is configured to ensure that the generated voltage does not exceed a predetermined limit. Such a voltage controller or limiter may thus be configured to temporarily overrule the operation in the current control mode.

In an embodiment, the first control signal of the control unit is based on the desired current of the plurality of series connected LEDs. For example, the control unit can be programmed to send a first control signal to control the power converter to provide a first current to the plurality of series connected LEDs, which first current is e.g. 50% of the desired current.

In an embodiment, the control unit comprises a first control terminal, which first control terminal receives the value of the desired current of the plurality of series connected LEDs. Preferably, the first control terminal of the control unit may be connected to a second control terminal or a user interface. Both non-limiting embodiments could provide information regarding the desired current of the plurality of series connected LEDs to the control unit. The user interface may e.g. be a remote control to select the desired current. The second control terminal could be an output terminal of an LED based light source comprising the plurality of series connected LEDs which may be connectable to the control unit.

According to a further aspect of the invention, there is provided a second LED driver, the LED driver being configured to drive a plurality of series connected LEDs, whereby a maximum allowed voltage output of the LED driver at an output terminal is lower than a forward voltage of the plurality of series connected LEDs in a cold state, the LED driver comprising:

- a power converter for converting an input power at an input terminal to a current at the output terminal,
- a control unit arranged to control the power converter, as such the power converter provides the current to the plurality of series connected LEDs,
- and wherein the control unit of the LED driver is further arranged to:
  - send a first control signal to the power converter to control the power converter to provide a first current, in value lower than a desired current, to the plurality of series connected LEDs, resulting in a forward voltage across the plurality of series connected LEDs not exceeding the maximum allowed voltage output of the second LED driver,
  - receive a forward voltage signal, representing the forward voltage across the plurality of series connected LEDs,
  - send a second control signal to the power converter, wherein the power converter steps up the first current to a second current, when the forward voltage across the plurality of series connected LEDs is lower than a predetermined fraction of the maximum allowed voltage output or maximum allowed output voltage minus a predetermined voltage step of the LED driver.

With this second LED driver according to the invention, the same or similar advantages can be achieved as with the first LED driver according to the invention. The power converter of second LED driver is powered at an input terminal by a power supply to drive the plurality of series connected LEDs by converting an input power at the input terminal to a current at an output terminal. Such a power supply may be a supply voltage.

To control the power converter to provide a first current, in value lower than a desired current, to the plurality of series connected LEDs, a control unit sends a first control signal to the power converter. The first current results in a forward voltage across the plurality of series connected LEDs not exceeding the maximum allowed voltage output of the second LED driver.

The control unit receives a forward voltage signal, representing the forward voltage across the plurality of series connected LEDs. Based on the forward voltage signal, when the forward voltage across the plurality of series connected LEDs is lower than a predetermined fraction of the maximum allowed voltage output or maximum allowed output voltage minus a predetermined voltage step of the second LED driver, the control unit send a second control signal to the power converter, wherein the power converter steps up the first to second current.

In an embodiment, the second LED driver according to the invention comprises the power converter controlled by the control unit to maintain the forward voltage across the plurality of series connected LEDs at a predetermined fraction of the maximum allowed voltage output or maximum allowed output voltage minus a predetermined voltage step of the LED driver. Preferably, the predetermined fraction is between 95-99.9% of the maximum allowed voltage output.

In an embodiment according to the invention, the forward voltage signal received by the control unit of the second LED driver is generated by a measurement circuit, which measurement circuit is configured to measure the forward voltage across or current through the plurality of series connected LEDs. For the latter, the measurement circuit could e.g. comprise a measurement element such as a resistance element to measure the current.

In an embodiment according to the invention, wherein the power converter of the second LED driver is configured to repeat the stepping up of the current, when receiving the control signal of the control unit, until the desired current is reached or the forward voltage is constantly equal to the predetermined fraction of the maximum allowed voltage of the second LED driver.

BRIEF DESCRIPTION OF THE FIGURES

Further advantages, embodiments and features of the invention will become clear from the appended figures and corresponding description, showing non-limiting embodiments in which.

DESCRIPTION

Figure 1:
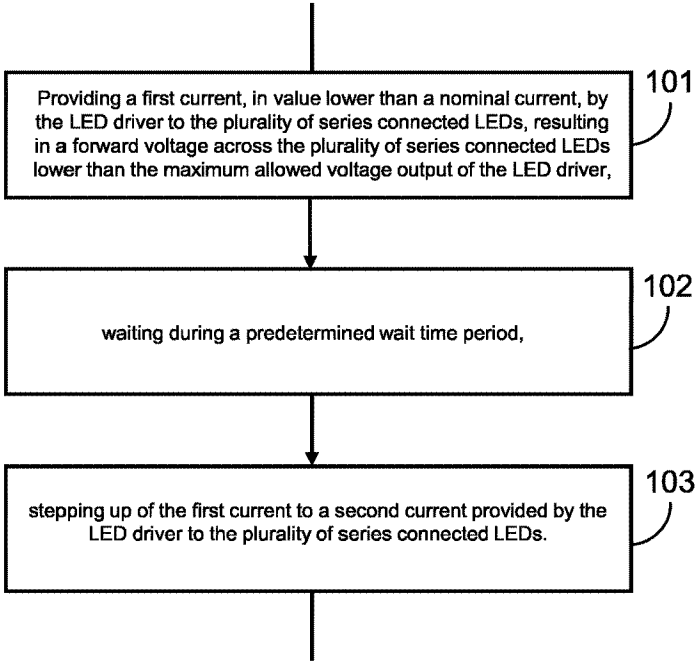
FIG. 1 schematically depicts an embodiment of a flow diagram of the first method according to the invention.

FIG. 1 schematically depicts a flow diagram of an embodiment of the first method according to the invention for starting up an illuminating process of a plurality of series connected LEDs by means of a LED driver, whereby a maximum allowed voltage output of the LED driver is lower than a forward voltage of the plurality of series connected LEDs in a cold state, at a desired current. The cold state of the plurality of series connected LEDs is a state wherein, for example, no current is provided by the LED driver to the plurality of series connected LEDs during a certain period, for example 1-5 minutes or more.

The first method comprises a first step 101 of providing a first current, in value lower than a desired current, by the LED driver to the plurality of series connected LEDs, resulting in a forward voltage across the plurality of series connected LEDs lower than the maximum allowed voltage output of the LED driver. Further the first method comprises a second step 102, waiting during a predetermined wait time period. Thereafter, the first method comprises a third step 103, stepping up of the first current to a second current provided by the LED driver to the plurality of series connected LEDs.

In an embodiment, the first current is a fraction of the desired current, preferably 10%-60% of the desired current, more preferably between 30%-50% of the desired current. The first current through the plurality of series connected LEDs will increase the operating temperature of the LEDs, which temperature increase causes a decrease of the forward voltage across the plurality of series connected LEDs. The forward voltage decrease depends e.g. on the type of LED and operating temperature. In general use, an LED commonly exhibits a direct relation between the forward voltage decrease and operating temperature, which is commonly situated between −1 mV/° C. to −5 mV/° C. The predetermined wait time period is selected to decrease the forward voltage sufficiently. Preferably, the predetermined wait time period is between 0-10 microseconds, more preferably between 5-10 microseconds. As will be understood, the lower the provided first current, the longer the wait time period will be to sufficiently heat up the LEDs.

After the predetermined wait time period, the forward voltage across the plurality of series connected LEDs is sufficiently decreased, which allows to step up the first current to a second current by the LED driver. The second current may be the desired current. If not, a second predetermined wait time period may be applied.

The first method according to the invention enables to start up or switch a larger number of LEDs by an LED driver, compared to known LED driver and light source combinations.

This may be easily demonstrated by a numerical example. Suppose that each LED unit of the plurality of series connected LEDs has a temperature dependence of the forward voltage of −4 mV/° C. The operating temperature in the cold state is e.g. considered to be room temperature, i.e. 20° C. The desired current of the LEDs is 1000 mA and the forward voltage of one LED unit in the cold state is 3.2 V. The maximum allowed voltage output which the LED driver can deliver is assumed to be 30 V. In this situation, the LED driver could drive 9 LEDs in serial connection. When applying a first current of 50% of the desired current, i.e. 500 mA, the operating temperature will approximately linearly increase with 10° C./microsec (until a maximum operating temperature of 90° C. is reached). The wait time period until the LED driver steps up the first current to the second current is set at 5 msec. In this example, the second current is equal to the desired current. After the wait time period, the operating temperature of the LEDs is thus increased by 50° C., which causes an forward voltage decrease of 200 mV across each LED.

As such, the forward voltage of one LED unit in this state is 3 V. When operating in this state, i.e. achieved by applying the first method according to the invention, the LED driver is able to drive 10 LEDs instead of 9 LEDs.

Hence, an advantage of the first method according to the invention, is that the number of series connected LEDs to be driven can be increased with a given maximum allowed voltage output of the LED driver.

Figure 2:
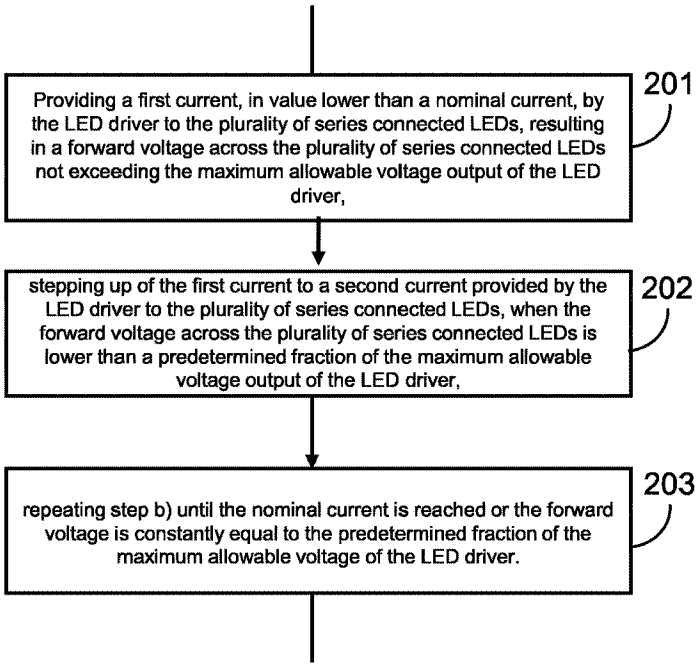
FIG. 2 schematically depicts an embodiment of a flow diagram of the second method according to the invention.

FIG. 2 schematically depicts an embodiment of a flow diagram of the second method according to the invention for starting up an illuminating process of a plurality of series connected LEDs by means of a LED driver, whereby a maximum allowed voltage output of the LED driver is lower than a forward voltage of the plurality of series connected LEDs in a cold state.

The second method comprises a first step 201, providing a first current in value lower than a desired current, by the LED driver to the plurality of series connected LEDs, resulting in a forward voltage across the plurality of series connected LEDs, resulting in a forward voltage across the plurality of series connected LEDs not exceeding the maximum allowed voltage output of the LED driver. Further the second method comprises a second step 202, stepping up the first current to a second current provided by the LED driver to the plurality of series connected LEDs, when the forward voltage across the plurality of series connected LEDs is lower than a predetermined fraction of the maximum allowed voltage output or maximum allowed output voltage minus a predetermined voltage step of the LED driver. Thereafter, in the third step 203, step 202 is repeated until the desired current or the predetermined fraction of the maximum allowed voltage is reached.

The first current may be a fraction of the desired current, preferably 10%-60% of the desired current, more preferably 30%-50% of the desired current. The first current through the plurality of series connected LEDs will heat up the LEDs, which temperature increase causes a decrease of the forward voltage across the plurality of series connected LEDs. As long as the forward voltage across the plurality of series connected LEDs is lower than the predetermined fraction of the maximum allowed voltage output or maximum allowed output voltage minus a predetermined voltage step of the LED driver, the first current can be stepped up to a second current. The predetermined fraction is preferably between 95%-99% of the maximum allowed voltage output of the LED driver. The second current in turn will heat up the LEDs even further, which causes a further decrease of the forward voltage across the plurality of series connected LEDs. As soon as the forward voltage is lower than the predetermined fraction of the maximum allowed voltage output or maximum allowed output voltage minus a predetermined voltage step of the LED driver, the current can again be stepped up. This process may be continuously repeated. A feedback loop can be applied to maintain the forward voltage across the plurality of series connected LEDs at the predetermined fraction of the maximum allowed voltage output or maximum allowed output voltage minus a predetermined voltage step of the LED driver. The second method according to the invention enables to start up or power a larger number of LEDs by an LED driver, compared to known LED driver and light source combinations. This may be easily demonstrated by a numerical example. Suppose that each LED unit of the plurality of series connected LEDs has a temperature dependence of the forward voltage of −4 mV/° C. The operating temperature in the cold state is e.g. considered to be room temperature, i.e. 20° C. The desired current of the LEDs is 1000 mA and the forward voltage of one LED unit in the cold state is e.g. 3.1 V at the desired current. The maximum allowed voltage output which the LED driver can deliver is assumed to be 60 V. In this situation, the LED driver could drive 19 LEDs in serial connection. In accordance with the second method according to the invention, at least 20 LEDs can be operated. In accordance with the second method, a first current, in value lower than a desired current, is supplied by the LED driver to the plurality of series connected LEDs, the first current resulting in a forward voltage across the plurality of series connected LEDs not exceeding the maximum allowed voltage output of the LED driver. Said first current can e.g. be 50% of the desired current, i.e. 500 mA. As a result of the application of the first current, the operating temperature of the LEDs will increase, e.g. at a rate of 15 degrees/microsec, and the forward voltage across the LEDs will decrease. In accordance with the second method according to the invention, the first current is increased when the forward voltage across the LEDs is lower than a predetermined fraction of the maximum allowed voltage output or maximum allowed output voltage minus a predetermined voltage step of the LED driver. The predetermined fraction of the maximum allowed voltage output or maximum allowed output voltage minus a predetermined voltage step of the LED driver may be set at e.g. 99.5%, i.e. 59.7 V. At the moment the first current is provided by the LED driver, the forward voltage across the LEDs may be determined by a voltage measurement circuit, which forward voltage may be e.g. 55 V. In accordance with the second method according to the invention, the first current is increased by the LED driver to a second current, which second current may be e.g. 75% of the desired current, i.e. 750 mA. In this example, the second current sets the forward voltage at e.g. 58 V. Again, the forward voltage across the plurality of series connected LEDs is lower than the predetermined fraction of the maximum allowed voltage output or maximum allowed output voltage minus a predetermined voltage step of the LED driver. Finally, the second current is stepped up by the LED driver to a third current, which third current is e.g. the desired current. The third current results in a forward voltage of e.g. 59.9 V.

When operating in this state, i.e. achieved by applying the second method according to the invention, the LED driver is able to drive 20 LEDs instead of 19 LEDs. Note that the regulated step-wise manner can be fine-tuned in more or smaller steps to obtain a continuous regulation of the provided current to the plurality of series connected LEDs.

Hence, an advantage of the second method according to the invention, is that the number of series connected LEDs to be driven can be increased with a given maximum allowed voltage output of the LED driver.

Figure 3A:
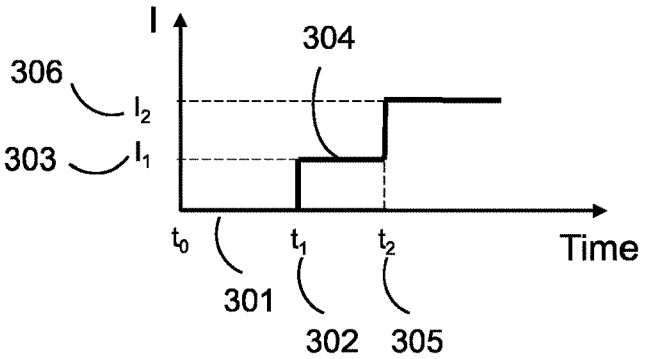
FIGS. 3*a* and 3*b* schematically depicts embodiments of a timing diagram of driving the plurality of series connected LEDs by the LED driver according to the first and second method according to the invention.

FIG. 3*a* depicts a timing diagram of driving the plurality of series connected LEDs by the LED driver according to the first method according to the invention, wherein the current provided by the LED driver to the plurality of series connected LEDs is plotted in function of time. Between $t_0$ and $t_1$, no current is provided by the LED driver, which means that the LEDs are in cold state during a time period 301. At time $t_1$ 302, the current is increased to a first current 303, which first current 303 is lower in value than the desired current. During a predetermined wait time period 304, the first current 303 heats the plurality of series connected LEDS, which results in a forward voltage decrease. At time $t_2$ 305, after the predetermined wait time period 304, the first current 303 is stepped up to a second current 306.

Figure 3B:
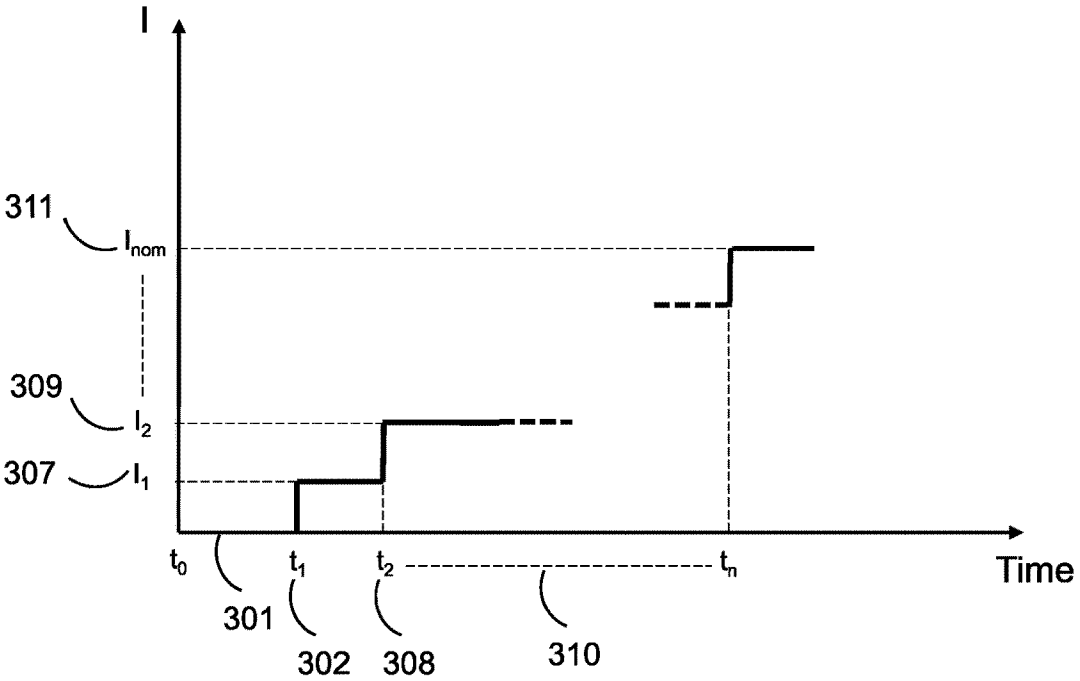

FIG. 3*b* depicts a timing diagram of driving the plurality of series connected LEDs by the LED driver according to the second method according to the invention, wherein the current provided by the LED driver to the plurality of series connected LEDs is plotted in function of time. Between $t_0$ and $t_1$, no current is provided by the LED driver, which means that the LEDs are in cold state during a time period 301. At time $t_1$ 302, the current is increased to a first current 307, which first current 307 is lower in value than the desired current. The first current 307 results in a forward voltage across the plurality of series connected LEDs not exceeding the maximum allowed voltage output of the LED driver. When said forward voltage across the series connected LEDs is lower than a predetermined fraction of the maximum allowed voltage output or maximum allowed output voltage minus a predetermined voltage step of the LED driver, the current supplied to the LEDs can be increased or stepped up. This is e.g. shown at time $t_2$ 308. At $t_2$ 308, the first current 307 is stepped up to a second current 309. Thereafter, the stepping up of the current can be repeated during a time 310 until the desired current $I_{noom}$ 311 or the predetermined fraction of the maximum allowed voltage is reached at time $t_n$. The latter case is not shown in the time diagram. By repeating the above, the more steps are introduced in the time diagram. For the sake of simplicity, these steps are indicated by dashed lines in the time diagram. The stepping up of the current could be performed in a regulated manner.

Figure 4:
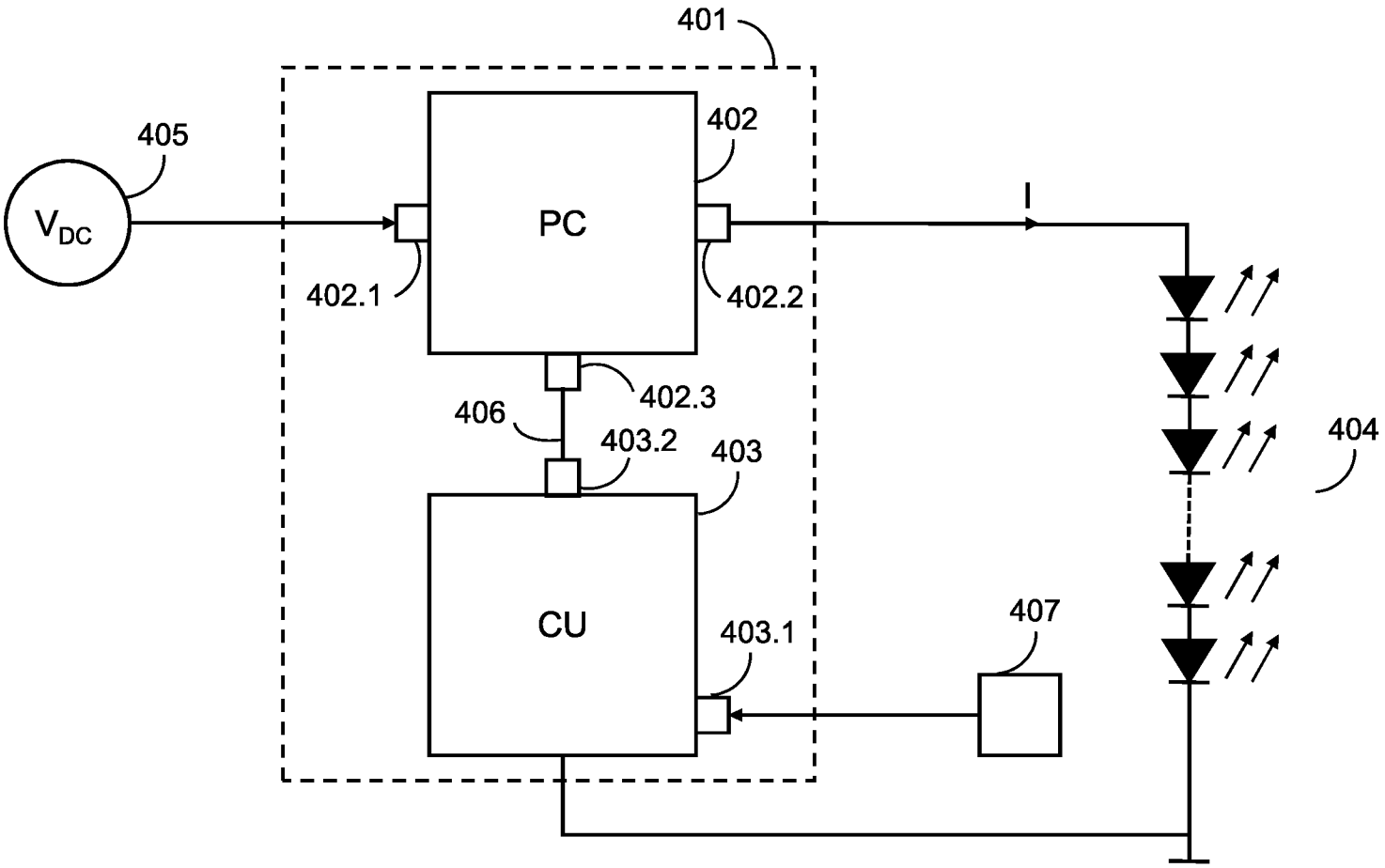
FIG. 4 schematically depicts an embodiment of the first LED driver according to the invention to drive the plurality of series connected LEDs.

FIG. 4 schematically depicts an embodiment of the first LED driver according to the invention, the first LED driver being configured to drive a plurality of series connected LEDs. In the embodiment as shown, the maximum allowed voltage output of the first LED driver 401 at an output terminal 402.2 of the first LED driver 401 is assumed to be lower than a forward voltage of the plurality of series connected LEDs 404 in a cold state. The first LED driver 401 comprises a power converter 402 for converting an input power at an input terminal 402.1 to a current I at the output terminal 402.2 and a control unit 403 arranged to control the power converter 402 such that the power converter 402 provides the current I to the plurality of series connected LEDs 404. The control unit 403 is further arranged to send a control signal via a communication connection 406 at an output control terminal 403.2 to an input control terminal 402.3 of the power converter 402 to control the power converter 402. A first control signal is send via the communication connection 406 by the control unit 403 to the power converter 402 to provide a first current, in value lower than a desired current, which first current results in a forward voltage across the plurality of series connected LEDs 404 that is lower than the maximum allowed voltage output of the first LED driver 401. Also, a second control signal is send via the communication connection 406 by the control unit 403 to the power converter 402 after a predetermined wait time period to step up the first current to a second current. The power converter 402 of the first LED driver 401 is powered at an input terminal 402.1 by a power supply 405. In FIG. 4, the power supply 405 is a DC supply voltage 405, supplying DC voltage $V_{DC}$. The required DC voltage can e.g. be derived from a mains supply, e.g. via an AC/DC converter. AC/DC converters are widely applied to convert an AC power source such as a mains connection (e.g. 230 V, 50 Hz) to a DC power source. The output of said DC power source may then be applied to power a load or may be applied to power a further power source such as a power converter of an LED driver. In an embodiment, the control unit 403 can comprise a first control terminal 403.1, which first control terminal 403.1 can receive the value of the desired current of the plurality of series connected LEDs 404. In FIG. 4, the first control terminal 403.1 of the control unit 403 is connected to a second control terminal 407. The second control terminal 407 may be an output terminal of e.g. a second control unit of a light fixture (not shown in FIG. 2), which light fixture comprises the plurality of series connected LEDs 404. The second control unit of the light fixture could be arranged to receive the current-voltage characteristics of each LED (e.g. the desired current) and send the information to the control unit 403 of the first LED driver 401. The second control unit may comprise any type of control unit, including e.g. analogue control electronics, digital control electronics, such as a micro controller, microprocessor, or any other suitable control device such as a Field Programmable Gate Array (FPGA), a programmable logic device (PLD), discrete logic electronics etc. Also other examples are applicable to obtain the current-voltage characteristics of each LEDs and provide the current-voltage characteristics to the control unit 403 of the first LED driver 401. Such examples e.g. include the use of RFID-tags or the use of reference resistances.

Figure 5:
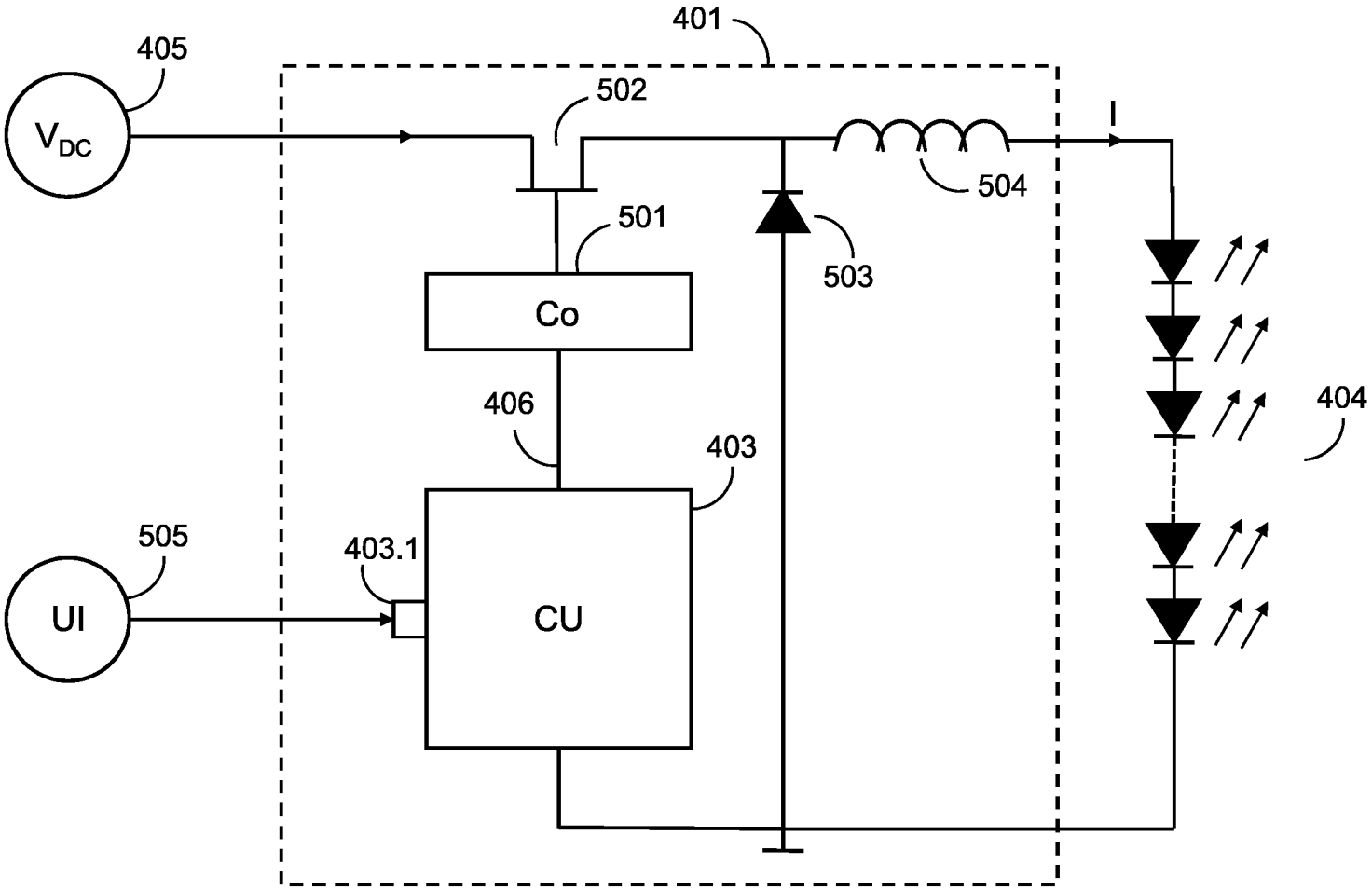
FIG. 5 schematically illustrates a switched mode power supply as the power converter of the first LED driver according to the invention to drive the plurality of series connected LEDs.

FIG. 5 schematically illustrates a switched mode power supply as the power converter of the first LED driver 401 according to the invention to drive the plurality of series connected LEDs 404. The first LED driver 401 as shown in FIG. 5 comprises a power converter or a switched mode power supply and a control unit 403 to control the power converter to drive the plurality of series connected LEDs 404 by providing a current I. The power converter as shown in FIG. 5 is a Buck converter, arranged to convert an input voltage $V_{DC}$ 405 to a current I. In general, such a switched mode power converter comprises an inductance 504, a unidirectional element 503 such as a diode and a switching element 502, e.g. a FET or a MOSFET. Also other types of converters such as boost, buck-boost, CUCK, SEPIC or other, either synchronous or non-synchronous may advantageously be applied in combination with the present invention. The switching of the switching element 502 can be controlled by a controller Co 501, based upon the control signal 406 received by said controller 501 from the control unit 403 of the first LED driver. Note that the functionality of the control unit 403 and the controller 501 can be combined into one control unit.

In an embodiment, the control unit 403 comprises a first control terminal 403.1, which first control terminal receives the value of the desired current of the plurality of series connected LEDs 404. In FIG. 5, the first control terminal of the control unit 403 is connected to an user interface 505. The user interface may e.g. be a remote control to select the desired current.

The first LED driver 401 in FIG. 5 further comprises the same features as the first LED driver in FIG. 4. A combination of the FIG. 4 and FIG. 5 embodiments may also be provided. As an example, the desired current received by the first control terminal 403.1 of the control unit 403 in FIG. 4, wherein the first control terminal 403.1 is connected to the second control terminal 407, may be used in FIG. 5, wherein the first control terminal 403.1 of the control unit 403 is connected to the user interface 505, and vice versa.

In an embodiment of the present invention, the first LED driver according to the present invention may be configured to perform the first method according to the invention in an open loop mode, i.e. substantially without any current or voltage feedback.

In such embodiment, the LED driver, in particular a control unit of the LED driver, may be configured to determine a first current to be applied to the plurality of series connected LEDs, said first current being lower than a desired current, whereby said first current results in a forward voltage lower than a predetermined boundary, e.g. imposed by a safety limit. In such embodiment, the control unit of the LED driver may require information about the voltage vs. current characteristic of the LEDs as applied, in particular about the temperature dependency of said characteristic, in order to determine the first current. Based on said information, the control unit may determine a sufficiently low first current, resulting in a forward voltage that does not breach the safety limit.

As an alternative to an open loop operation, the first LED driver according to the present invention may be controlled according to a current control mode or voltage control mode, including a current of voltage feedback.

In such embodiment, the first LED driver according to the invention, in particular the control unit 403 of the LED driver, may be configured to receive an input signal representing the current as supplied by the LED driver to the plurality of series connected LEDs 404. Such an input signal representing the actual current as supplied may be applied as a feedback signal by the control unit 403 to control the power converter of the LED driver, thus enabling a more accurate current control. Such a current measurement may e.g. be provided by a current measurement circuit as described below.

The first LED driver according to the invention may thus be considered to operate in a current control mode, either in open-loop or closed-loop, i.e. with or without a current feedback signal.

Alternatively or in addition, the LED driver may be equipped with a voltage controller or limiter that is configured to ensure that the generated voltage does not exceed a predetermined limit. Such a voltage controller or limiter may thus be configured to, e.g. temporarily, overrule the operation in the current control mode.

Note that the application of a voltage limiter may advantageously be combined with an open loop current control, i.e. a current control mode which does not include a current feedback loop. In such embodiment, the voltage limiter may act as a fail-safe mechanism in case the selected first current would result in an output voltage that is too high, e.g. above a predetermined limit.

Figure 6:
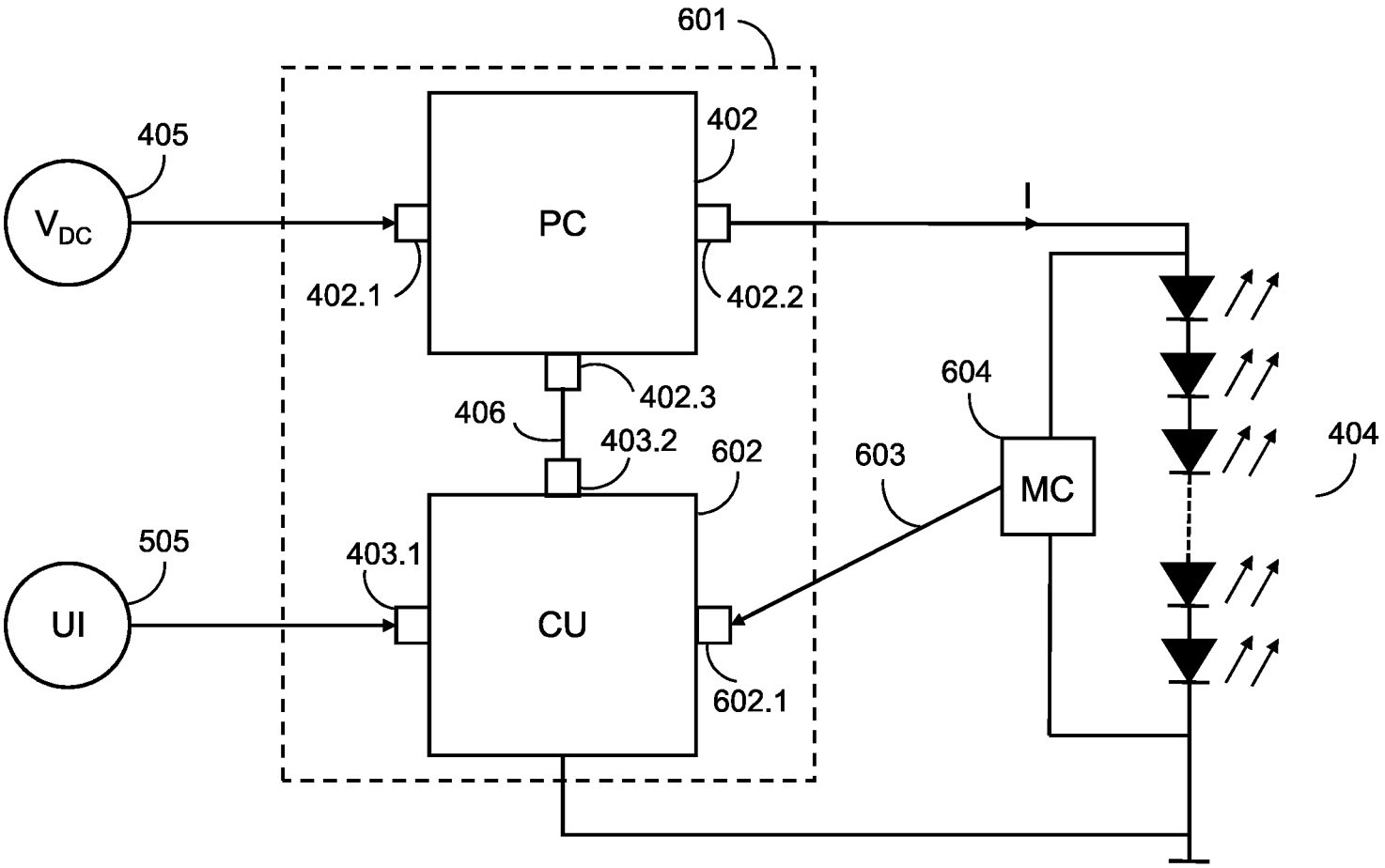
FIGS. 6-7 schematically depicts embodiments of the second LED driver according to the invention to drive the plurality of series connected LEDs.

FIG. 6 schematically depicts an embodiment of the second LED driver 601 according to the invention to drive the plurality of series connected LEDs 404. The maximum allowed voltage output of the second LED driver 601 at an output terminal 402.2 is deemed to be lower than a forward voltage of the plurality of series connected LEDs 404 in a cold state. The second LED driver 601 comprises a power converter (PC) 402 for converting an input power at an input terminal 402.1 to a current I at the output terminal 402.2 and a control unit (CU) 602 arranged to control the power converter 402 as such the power converter 402 provides the current I to the plurality of series connected LEDs 404. The control unit 602 is further arranged to send a control signal via a communication connection 406 at an output control terminal 403.2 to an input control terminal 402.3 of the power converter 402 to control the power converter 402. A first control signal is sent via the communication connection 406 by the control unit 602 to the power converter 402 to provide a first current, in value lower than a desired current, which first current results in a forward voltage across the plurality of series connected LEDs 404 lower than the maximum allowed voltage output of the second LED driver 601. Further, the control unit 602 is configured to receive a forward voltage signal 603 representing the forward voltage across the plurality of series connected LEDs 404. The forward voltage signal 603 may be provided at a communication terminal 602.1 of the control unit 602 by a forward voltage measurement circuit (MC) 601, which forward voltage measurement circuit 604 is arranged to (continuously) measure the forward voltage across the plurality of series connected LEDs 404.

When the forward voltage across the plurality of series connected LEDs 404 is lower than a predetermined fraction of the maximum allowed voltage output or maximum allowed output voltage minus a predetermined voltage step of the second LED driver 601, the control unit 602 is arranged to send a second control signal via the communication connection 406 to the power converter 402, the second control signal causing the power converter 402 to step up the first current to a second current. The second control signal of the control unit 602 is based on the forward voltage across the plurality of series connected LEDs 404. The power converter 402 is configured to repeat the stepping up of the current when receiving the control signal via the communication connection 406 of the control unit 602, until the desired current is reached or the forward voltage is substantially equal to the predetermined fraction of the maximum allowed voltage of the second LED driver 601. The power converter 402 could be controlled by the control unit 602 to maintain the forward voltage across the plurality of series connected LEDs 404 at the predetermined fraction of the maximum allowed voltage output or maximum allowed output voltage minus a predetermined voltage step of the second LED driver 601. This could be accomplished by a regulated feedback loop between the second LED driver 601 and the forward voltage measurement circuit 604.

The power converter 402 of the second LED driver 601 is powered at an input terminal 402.1 by a power supply 405. In FIG. 6, the power supply 405 is a supply voltage 405, e.g. supplying a substantially constant DC voltage $V_{DC}$. The required DC voltage can e.g. be derived from a main supply.

Figure 7:
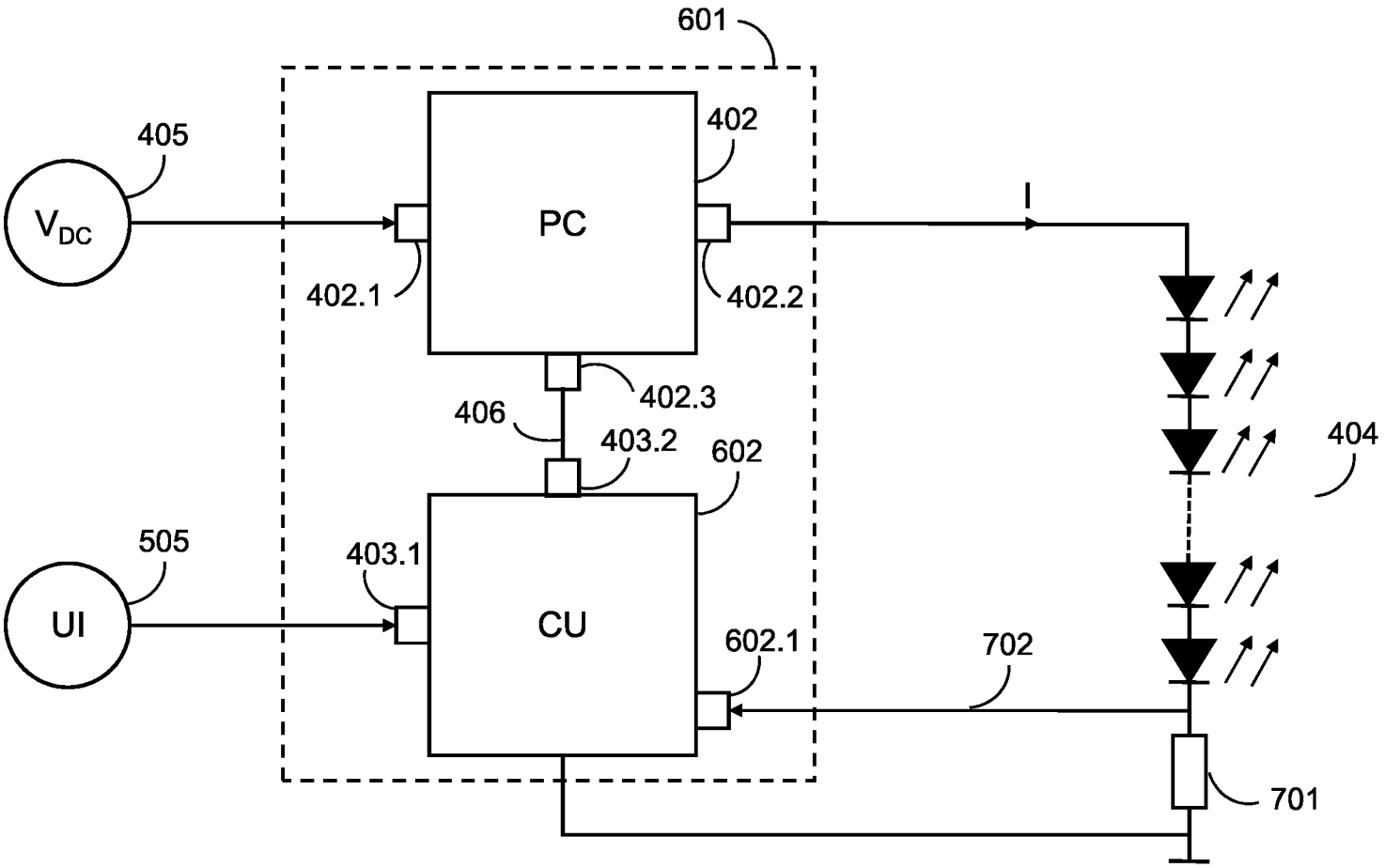

FIG. 7 schematically depicts an embodiment of the second LED driver 601 according to the invention to drive the plurality of series connected LEDs 404. The features of FIG. 6 are also applicable to the embodiment of FIG. 7. In particular, the embodiment of the second LED driver 601 as shown in FIG. 7 may also be equipped with a measurement circuit for measuring the forward voltage across the plurality of series connected LEDs 404.

Also, other measurement examples may be provided to detect the forward voltage across the plurality of series connected LEDs 404. In an embodiment, information concerning the operating temperature of the plurality of series connected LEDs 404 may be measured, which operating temperature may provide indirect information concerning the forward voltage. In general use, an LED commonly exhibits a direct relation between the forward voltage and operating temperature, which is commonly situated between −1 mV/° C. to −5 mV/° C. The temperature dependence could be provided to the control unit. In addition, the control unit knows from the sent control signal to the power converter 402 the provided current through the plurality of series connected LEDs. From the temperature measurement and known provided current, the control unit 602 could determine the forward voltage across the plurality of series connected LEDs. Thus, the operating temperature may be a trigger for the control unit 602 for sending a control signal via the communication terminal 406 to the power converter 402 to adjust the current, when the forward voltage is lower than the predetermined fraction of the maximum allowed voltage output or maximum allowed output voltage minus a predetermined voltage step of the second LED driver.

In an embodiment, the current I through the plurality of series connected LEDs 404 as provided by the second LED driver 601 can be determined from a current measurement circuit 701. The current measurement circuit 701 may comprise a resistance element, which resistance element is placed in serial connection with the plurality of series connected LEDs. The voltage across the resistance element combined with the know resistance value from the resistance element thus enables to determine the value of the current through the plurality of series connected LEDs, which current value could be fed back to the control unit by the current measurement circuit. In this embodiment, the current feedback loop gives an extra check on the provided current by actively measuring the provided current. In a further embodiment, using the measurement of the operating temperature of the plurality of series connected LEDs 404, combined with the measurement of the provided current, the current measurement circuit 701 may be configured to send a forward voltage signal 702, representing the measured forward voltage. The forward voltage signal 702 could be provided to the communication terminal 602.1 of the control unit 602.

The embodiments in FIGS. 6-7 representing the second LED driver 601 according to the invention make use of one or more regulated feedback loops, whereas such feedback loops may not be required for the embodiments in FIGS. 4-5 representing the first LED driver 401 according to the invention. The first LED driver 401 according to the present invention can be operated in open-loop, i.e. without any current or voltage feedback. The second LED driver according to the invention may include a current feedback or voltage feedback so as to determine the forward voltage across the plurality of series connected LEDs. As a result, the complexity and costs may be higher for the second LED driver 601. However, the feedback loop in the second LED driver 601 may allow a more regulated and stable light output. compared to the application of the first LED driver 401.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

The invention claimed is:

1. A method for starting up an illuminating process of a plurality of series connected LEDs by means of a LED driver, whereby a maximum allowed voltage output of the LED driver is lower than a forward voltage of the plurality of series connected LEDs in a cold state at a desired current, and whereby the maximum allowed voltage output of the LED driver corresponds to a maximum allowed voltage imposed by a safety standard, comprising:

a) providing a first current, in value lower than the desired current, by the LED driver to the plurality of series connected LEDs, resulting in an increased operating temperature of the LEDs and a forward voltage across the plurality of series connected LEDs lower than the maximum allowed voltage output of the LED driver, b) waiting during a predetermined wait time period, and c) stepping up of the first current to a second current provided by the LED driver to the plurality of series connected LEDs, wherein the predetermined wait time period is selected to enable a decrease in the forward voltage across the plurality of series connected LEDs to allow the stepping up of the first current to the second current.

2. The method according to claim 1, wherein the predetermined wait time period is between 0-10 microseconds.

3. The method according to claim 2, wherein the predetermined wait time period is between 5-10 microseconds.

4. The method according to claim 1, wherein the second current is the desired current of the plurality of series connected LEDs.

5. The method according to claim 1, wherein the first current in step a) is a fraction of the desired current, preferably 10%-60% of the desired current.

6. The method according to claim 5, wherein the first current in step a) is a fraction of the desired current, preferably 30%-50% of the desired current.

7. A method for starting up an illuminating process of a plurality of series connected LEDs by means of a LED driver, whereby a maximum allowed voltage output of the LED driver is lower than a forward voltage of the plurality of series connected LEDs in a cold state at a desired current, and whereby the maximum allowed voltage output of the LED driver corresponds to a maximum allowed voltage imposed by a safety standard, comprising:

a) providing a first current, in value lower than the desired current, by the LED driver to the plurality of series connected LEDs, resulting in an increased operating temperature of the LEDs and a forward voltage across the plurality of series connected LEDs not exceeding the maximum allowed voltage output of the LED driver, b) stepping up of the first current to a second current provided by the LED driver to the plurality of series connected LEDs, when the forward voltage across the plurality of series connected LEDs is lower than a predetermined fraction of the maximum allowed voltage output or maximum allowed output voltage minus a predetermined voltage step of the LED driver, wherein the predetermined fraction is selected to enable a decrease in the forward voltage across the plurality of series connected LEDs to allow the stepping up of the first current to the second current, and c) repeating step b) until the desired current is reached or the forward voltage is constantly equal to the predetermined fraction of the maximum allowed voltage of the LED driver.

8. The method according to claim 7, wherein the forward voltage across the plurality of series connected LEDs in step a) is equal to the maximum allowed voltage output of the LED driver.

9. The method according to claim 7, wherein the predetermined fraction in step b) is between 90%-95% of the maximum allowed voltage output of the LED driver.

10. The method according to claim 7, wherein the step b) is preceded by measuring the forward voltage across the plurality of series connected LEDs by a voltage measurement circuit.

11. The method according to claim 7, wherein the step b) is preceded by measuring a current through the plurality of series connected LEDs by a current measurement circuit.

12. The method according to claim 7, whereby the maximum allowed voltage imposed by the safety standard is 60 V.

13. An LED driver configured to drive a plurality of series connected LEDs, whereby a maximum allowed voltage output of the LED driver at an output terminal is lower than a forward voltage of the plurality of series connected LEDs in a cold state at a desired current, and whereby the maximum allowed voltage output of the LED driver corresponds to a maximum allowed voltage imposed by a safety standard, the LED driver comprising:

a power converter for converting an input power at an input terminal to a current at the output terminal, and a control unit arranged to control the power converter, as such the power converter provides the current to the plurality of series connected LEDs, wherein the control unit of the LED driver is further arranged to:

send a first control signal to the power converter to control the power converter to provide a first current, in value lower than the desired current, to the plurality of series connected LEDs, resulting in an increased operating temperature of the LEDs and a forward voltage across the plurality of series connected LEDs lower than the maximum allowed voltage output of the LED driver, and send a second control signal to the power converter after a predetermined wait time period to control the power converter to step up the first current to a second current wherein the predetermined wait time period is selected to enable a decrease in the forward voltage across the plurality of series connected LEDs to allow the step up of the first current to the second current.

14. The LED driver according to claim 13, wherein the power converter is controlled by the control unit to maintain the forward voltage across the plurality of series connected LEDs at a predetermined fraction of the maximum allowed voltage output or the maximum allowed output voltage minus a predetermined voltage step of the LED driver.

15. An LED driver configured to drive a plurality of series connected LEDs, whereby a maximum allowed voltage output of the LED driver at an output terminal is lower than a forward voltage of the plurality of series connected LEDs in a cold state at a desired current, and whereby the maximum allowed voltage output of the LED driver corresponds to a maximum allowed voltage imposed by a safety standard, the LED driver comprising:

a power converter for converting an input power at an input terminal to a current at the output terminal, and a control unit arranged to control the power converter, as such the power converter provides the current to the plurality of series connected LEDs, wherein the control unit of the LED driver is further arranged to:

send a first control signal to the power converter to control the power converter to provide a first current, in value lower than the desired current, to the plurality of series connected LEDs, resulting in an increased operating temperature of the LEDs and a forward voltage across the plurality of series connected LEDs not exceeding the maximum allowed voltage output of the LED driver, receive a forward voltage signal, representing the forward voltage across the plurality of series connected LEDs, and send a second control signal to the power converter, wherein the power converter steps up the first current to a second current, when the forward voltage across the plurality of series connected LEDs is lower than a predetermined fraction of the maximum allowed voltage output or the maximum allowed output voltage minus a predetermined voltage step of the LED driver, wherein the predetermined fraction is selected to enable a decrease in the forward voltage across the plurality of series connected LEDs to allow the step up of the first current to the second current.

16. The LED driver according to claim 15, wherein the forward voltage signal received by the control unit is generated by a measurement circuit, which measurement circuit is configured to measure the forward voltage across or current through the plurality of series connected LEDs.

17. The LED driver according to claim 15, wherein the power converter is configured to repeat the stepping up of the current, when receiving the control signal of the control unit, until the desired current is reached or the forward voltage is constantly equal to the predetermined fraction of the maximum allowed voltage of the LED driver.

18. The LED driver according to claim 15, wherein the first control signal of the control unit is based on the desired current of the plurality of series connected LEDs.

19. The LED driver according to claim 15, wherein the second control signal of the control unit is based on the forward voltage of the plurality of series connected LEDs.

20. The LED driver according to claim 15, wherein the control unit comprises a first control terminal, which first control terminal receives the value of the desired current of the plurality of series connected LEDs.

21. The LED driver according to claim 15, wherein the first control terminal of the control unit is connected to a second control terminal or an user interface.

22. The LED driver according to claim 15, wherein the input terminal of the power converter is connected to a supply voltage.

23. The LED driver according to claim 15, wherein the power converter is a fly back converter, preferably a buck or boost converter.

24. The LED driver according to claim 15, whereby the maximum allowed voltage imposed by the safety standard is 60 V.

* * * * *